US008167371B2

(12) United States Patent
Underwood

(10) Patent No.: US 8,167,371 B2
(45) Date of Patent: May 1, 2012

(54) SEAT WITH DYNAMIC SEAT BACK

(76) Inventor: Mark Carl Underwood, Peterborough (GB)

( * ) Notice: Subject to any disclaimer, the term of this patent is extended or adjusted under 35 U.S.C. 154(b) by 139 days.

(21) Appl. No.: 12/306,529

(22) PCT Filed: Mar. 31, 2008

(86) PCT No.: PCT/GB2008/001081

§ 371 (c)(1),
(2), (4) Date: Dec. 24, 2008

(87) PCT Pub. No.: WO2008/129231

PCT Pub. Date: Oct. 30, 2008

(65) Prior Publication Data

US 2009/0195038 A1 Aug. 6, 2009

(30) Foreign Application Priority Data

Apr. 23, 2007 (GB) ..... 0707789.4

(51) Int. Cl.
*A47C 3/00* (2006.01)
*A47C 1/024* (2006.01)

(52) U.S. Cl. ..... 297/299; 297/301.2; 297/303.2

(58) Field of Classification Search ..... 297/299, 297/301.1, 301.2, 303.2, 230.13
See application file for complete search history.

(56) References Cited

U.S. PATENT DOCUMENTS

| | | | | |
|---|---|---|---|---|
| 3,059,971 | A | 10/1962 | Becker | |
| 4,533,177 | A * | 8/1985 | Latone | 297/303.5 |
| 4,813,743 | A * | 3/1989 | Mizelle | 297/301.2 |
| 5,228,747 | A | 7/1993 | Greene | |
| 5,385,388 | A * | 1/1995 | Faiks et al. | 297/301.3 |
| 5,419,615 | A * | 5/1995 | Dozsa-Farkas | 297/301.2 |
| 5,447,356 | A | 9/1995 | Snijders | |
| 5,486,056 | A * | 1/1996 | Thorn | 403/322.4 |
| 5,501,507 | A | 3/1996 | Hummitzsch | |
| 5,704,689 | A | 1/1998 | Kim | |
| 6,715,834 | B1 * | 4/2004 | Liao | 297/362.13 |
| 7,249,801 | B2 * | 7/2007 | Tonin | 297/300.5 |
| 7,278,685 | B1 * | 10/2007 | Lin | 297/301.7 |
| 7,585,028 | B2 * | 9/2009 | Jenkins | 297/302.3 |
| 2005/0184570 | A1 | 8/2005 | Sanchez | |
| 2005/0280300 | A1 * | 12/2005 | Tin | 297/300.3 |

FOREIGN PATENT DOCUMENTS

| | | | |
|---|---|---|---|
| DE | 202004016372 | U1 | 1/2005 |
| EP | 1234530 | A | 8/2002 |
| WO | WO86/02243 | A | 4/1986 |
| WO | WO2005/006917 | A | 1/2005 |

OTHER PUBLICATIONS

International Search Report dated Nov. 5, 2009.

* cited by examiner

*Primary Examiner* — Sarah B McPartlin
(74) *Attorney, Agent, or Firm* — Endurance Law Group PLC

(57) ABSTRACT

A seat back assembly (16) for a seat (10), comprising an upper seat back portion (24) for supporting an upper portion of a user's back and a lower seat back portion (22) for supporting a user's pelvis and pelvic region. The lower seat back portion (22) and the upper seat back portion (24) are independently adjustable. The upper seat back portion (24) can be reclined to one of a number of fixed angular positions and it is arranged and configured for dynamic angular movement under a load over a range of positions. The dynamic movement of the upper seat back portion (24) is controlled by a shock absorber (44) having adjustable damping means for providing a required level of tension and rebound in relation to the dynamic back action of the upper seat back portion (24).

15 Claims, 4 Drawing Sheets

FIG. 3
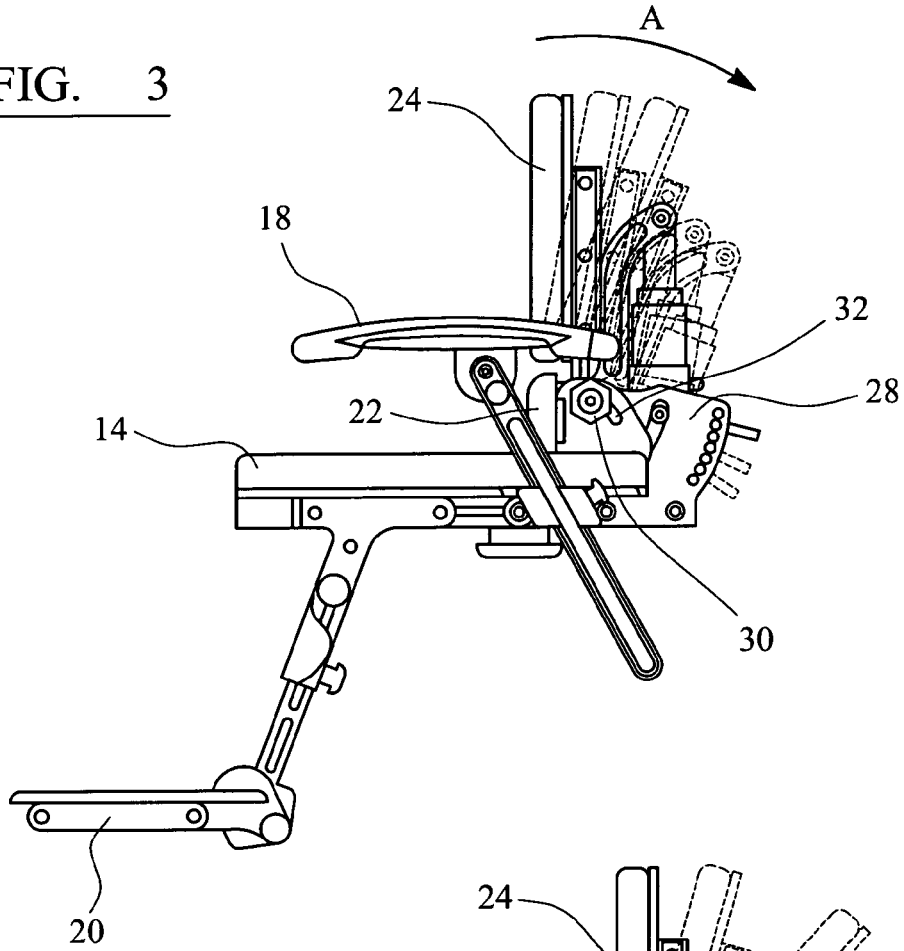
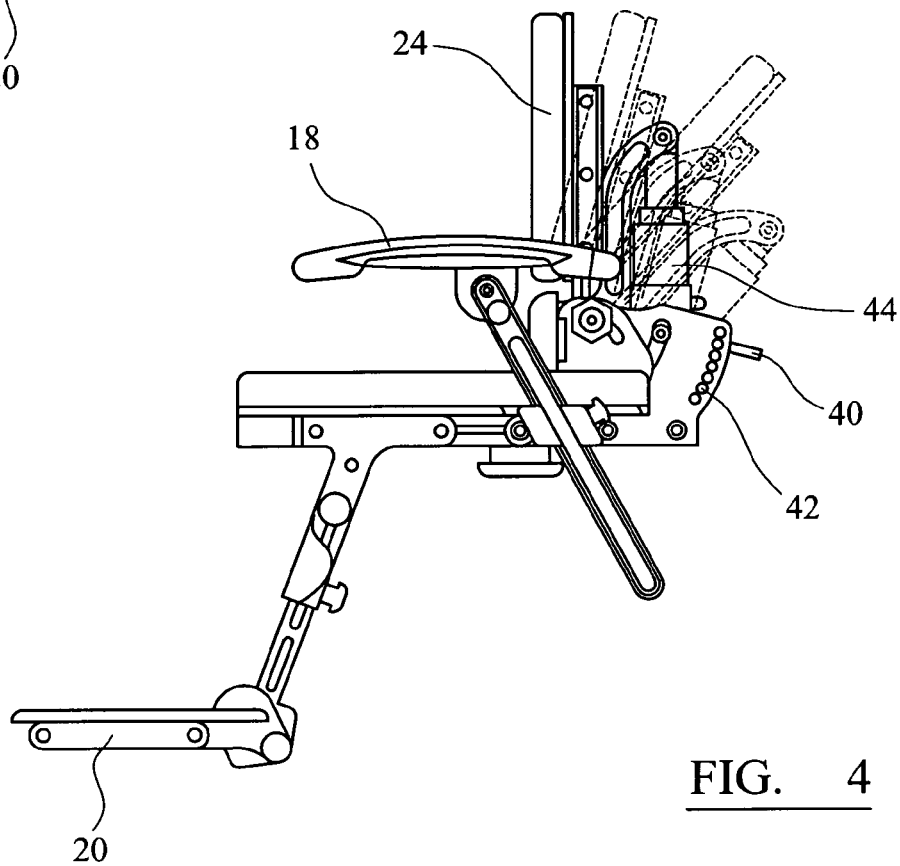
FIG. 4

FIG. 5A
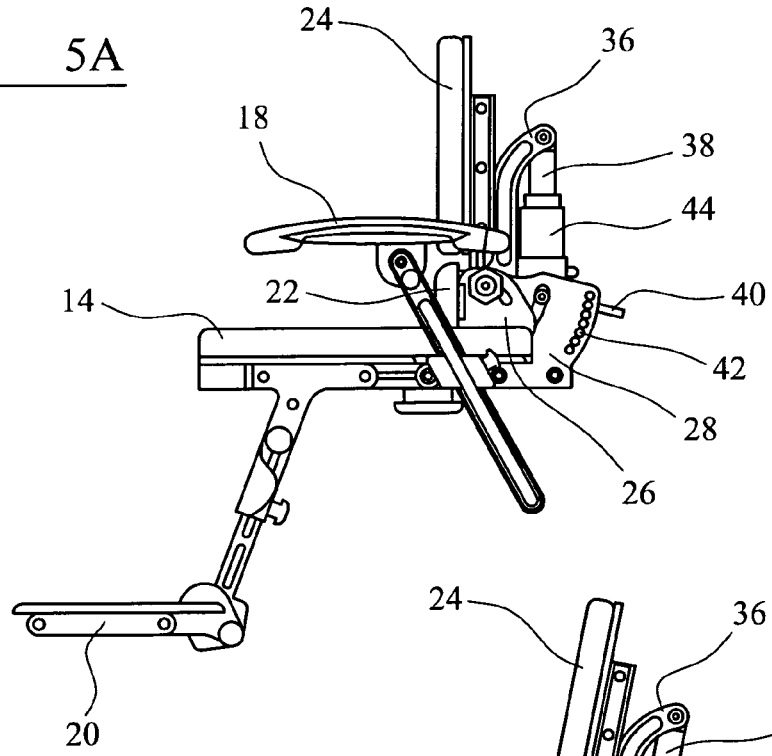
FIG. 5B
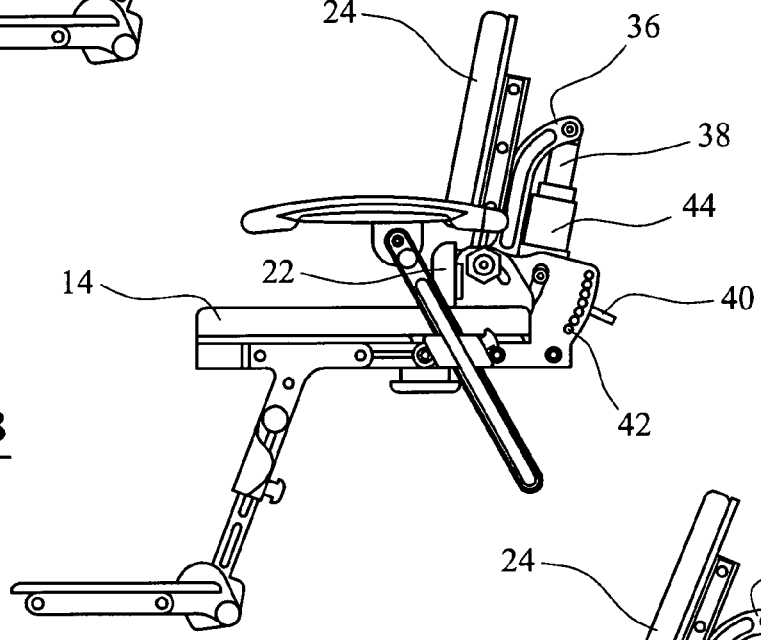
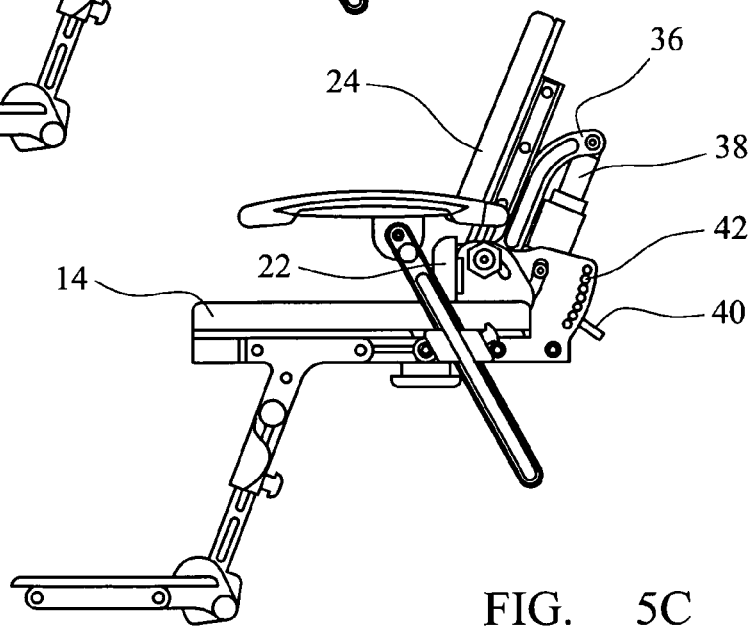
FIG. 5C

FIG. 6A
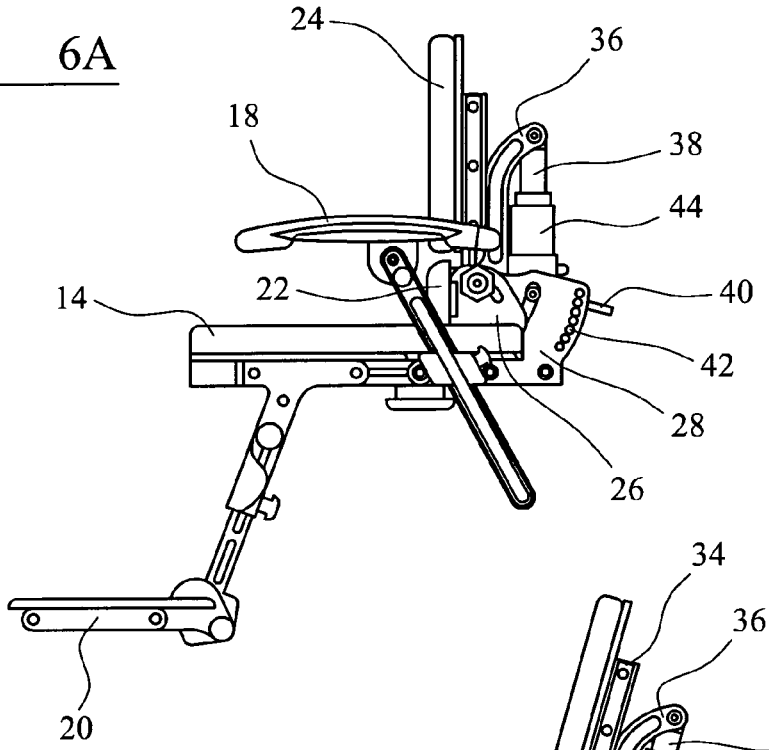
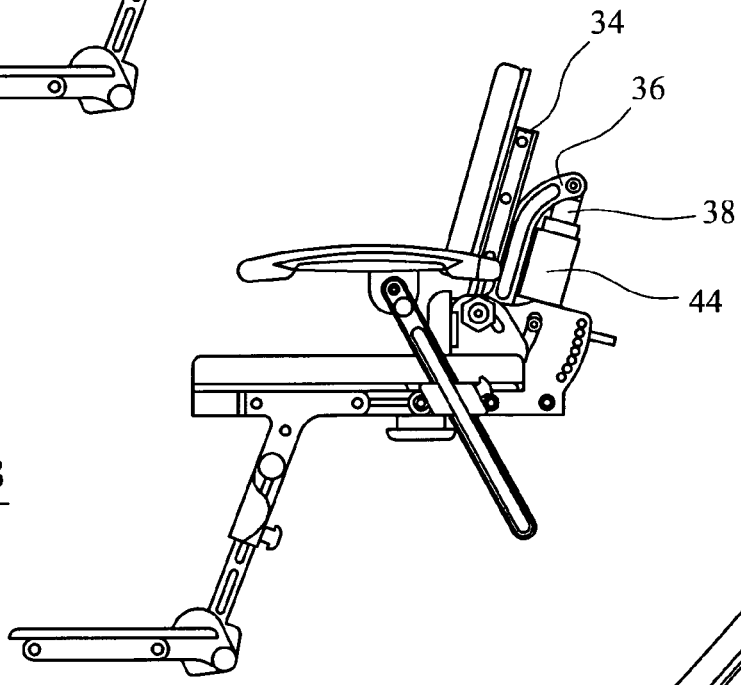
FIG. 6B
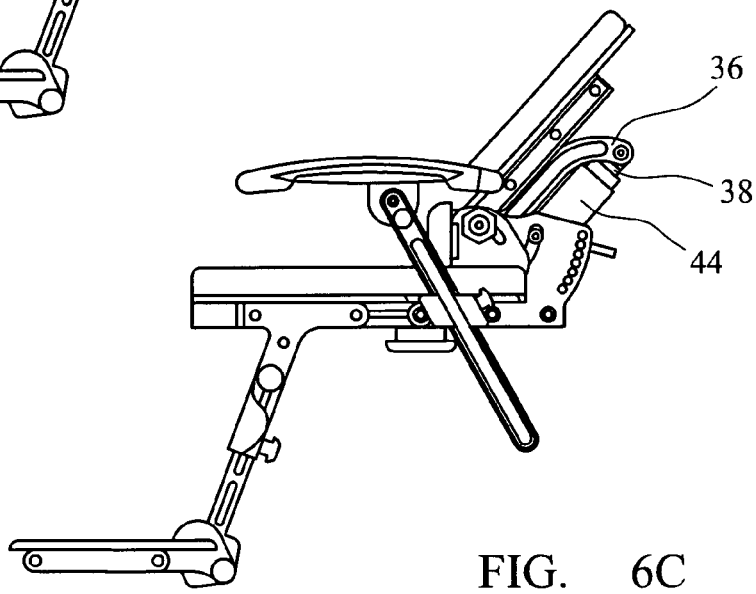
FIG. 6C

SEAT WITH DYNAMIC SEAT BACK

BACKGROUND OF THE INVENTION

1. Field of the Invention

The present invention relates to seats, in particular an improved seat back arrangement for a seat. More specifically the present invention relates to a seat for those with a disability.

2. Related Art

It is generally desirable to make a seat as comfortable as possible, while providing adequate support and ensuring a good postural position, to a user. This is particularly so in seats for those with a disability who may spend prolonged periods in such a seat.

In addition disabled users may require a seat that provides specific support, and in addition they may place further demands, in particular in terms of robustness of the seat, on the design of a seat. Such specialist disabled seats and seating systems may be for use as a wheelchair, by attachment to a suitable wheeled base, or may be for freestanding fixed use with or without height adjustment.

Seats may incorporate an adjustable seat back which can, in particular, be pivoted about its lower attachment to the seat bottom reclined to various reclined positions to support and suit a user. In most conventional seats the seat back is fixed in the various adjusted reclined positions and the seat back provides a rigid supporting surface. Indeed a number of seats specifically seek to provide such a rigid supporting surface to support a user. However such rigid seat backs can be uncomfortable.

In addition to withstand the forces which may be applied by a user the seat must be relatively robust resulting in a relatively massive and heavy structure to withstand the loads on the seat back.

Examples of various disabled seating arrangements which incorporate seat backs which although adjustable are fixed in use are described in U.S. Pat. Nos. 5,228,747 and 5,447,356. As mentioned such seat backs can be uncomfortable due to their inflexibility.

Seats with moveable seat backs which can flex to accommodate and absorb movement and loading by a user, so called dynamic seats, are also known. These seats incorporate springs, typically gas springs, to resist movement of the seat back and absorb the loading and rearward movement of the seat back. Once loading is removed, and for example when a user leans forward, the seat back springs back into an upright position. Such seats are however less common especially in specialist seats for those with disabilities, and in general are relatively crude.

Examples of various movable seat back arrangements are described in U.S. 2005/018450; U.S. Pat. Nos. 5,501,507; 3,059,971 and 5,704,689. These however all relate to office or task chairs rather than the more specific disabled seating arrangements, and are not tailored nor adapted to meet the specific and exacting demands of disabled seats. Indeed there are problems with such arrangements that can be improved.

Overall, and in particular in the context of disabled seating, it has been found that there are problems with both the conventional adjustable seat back arrangements and the conventional dynamic seat backs, and that both arrangements can be improved.

In particular in some conventional adjustable seat back arrangements and conventional dynamic seat backs the entire seat back pad provides a single rigid support surface and/or moves as single unit. In use when a user leans back against the seat back loading is primarily via the shoulder region and upper part of the back. Resulting forces are then transferred through the lower body and seat back and the pelvis, and legs, are forced forward on the seat. This may leave the lower back unsupported and the user in an asymmetric position. With conventional dynamic backs the position of the pelvis may similarly be moved as the seat back moves.

Alternatively with some of the dynamic seat back arrangements the rearward movement of the seat back allows the pelvis to move rearward. Once the seat back then returns to the upright position, since the position of the pelvis region has been altered, the seat back may undesirably force the user forwards and/or otherwise alter the position of the user on the seat. These problems are particularly experienced by those who have particular muscular control problems, and extensor problems, for example those associated with cerebral palsy, where the user may arch their back and provide uneven loading on the seat back. As a result the seat does not provide the best support nor ensure good posture of the user within the seat.

In addition, it has also been found, especially with the relatively crude spring return movement provided by conventional dynamic seat back arrangements, that some disabled users may respond by continually moving and bouncing against the seat back. This is generally undesirable, and also means that the seat and seat back has to be reinforced to withstand such repeated impact loading.

It is therefore desirable to provide an improved seat arrangement which addresses the above identified problems and/or which more generally offers improvements or an alternative over existing arrangements

SUMMARY OF THE INVENTION

According to the present invention there is therefore provided a seat as described in the accompanying claims.

In a first embodiment of the invention there is provided seat back assembly for a seat comprising a first seat back portion defining a first back support surface for supporting a first portion of a user's back, and a second seat back portion defining a second back support surface for supporting a second portion of a user's back, wherein the second portion is moveable independently to the first portion.

The seat back assembly provides, in particular disabled users, with improved support in an upright position in which the pelvis is better maintained at set angle to ensure a good postural position.

In addition, the seat back assembly accommodates upper body movement or absorb forces from extensor patterns commonly associated, for example with cerebral palsy.

Beneficially, the first seat back portion is a lower seat back portion defining a lower back support surface for supporting a lower portion of a user's back, and the second seat back portion is an upper seat back portion for supporting an upper portion of a user's back. The lower seat back portion is preferably arranged and configured to support the pelvis and pelvic region of a user sitting on the seat.

In one exemplary embodiment, the assembly may comprise a base frame, wherein the first and second seat back portions are mounted from the base frame. The lower seat back portion is beneficially adjustable in terms of one or more of its height, its angle relative to the seat, its longitudinal position relative to the seat. Accordingly, the lower seat back portion is preferably pivotally mounted relative to the above-mentioned base frame.

The upper seat back portion is preferably reclineably moveable relative to the seat. Accordingly, the upper seat back portion may be reclineable to a selected one of a number of fixed angular positions. Alternatively or in addition, the upper seat back portion may be reclineably mounted for movement under a load over a range of angular positions, possibly from a fixed position. In the case where the upper seat back portion is mounted for dynamic reclining movement (under a load over a range of angular positions), the upper seat back portion is preferably biased to a forward upright position. The forward biasing force is beneficially adjustable. Furthermore, a damper is preferably provided to resist (i.e. slow) movement of upper seat back portion. In this case, the damping force provided by the damper is preferably also adjustable. The biasing and damping forces are beneficially provided in a shock absorber for controlling movement of the upper seat back portion.

The upper and/or lower seat back portions are preferably provided with respective cushioned pads for the comfort of the user.

In a second embodiment of the invention there is provided a seat back assembly for a seat comprising a seat back portion defining a back support surface for supporting a user's back, said seat back portion being moveable under an applied load over a range of positions, and a damper for restraining motion of said seat back portion.

In a specific exemplary embodiment of the present invention, there is provided a seat back assembly for a seat comprising a seat for supporting a user's weight and a seat back portion defining a support surface for supporting a user's back, wherein said seat back portion is moveable relative to said seat, under an applied load over a range of positions, and wherein shock absorbing means are provided for applying a tension and/or rebound force in respect of movement of said seat back portion, said shock absorbing means having means for adjusting the tension and/or rebound force applied thereby.

In one exemplary embodiment, the seat back portion is provided with an arm member, telescopically mounted in a housing containing damping means, wherein movement of said seat back portion causes corresponding movement of said arm member within said housing.

The present invention extends to a seat comprising a seat base frame, a seat for supporting a user and a seat back assembly as defined above mounted on the seat base frame and extending at an angle to the seat.

These and other aspects of the present invention will be apparent from, and elucidated with reference to, the embodiments described herein.

BRIEF DESCRIPTION OF THE DRAWINGS

The present invention will now be described by way of example only with reference to the following figures in which:

FIG. 3 is a side view of the seat shown in FIG. 1 showing the seat back assembly in various adjusted reclined positions;

FIG. 4 is a side view of the seat shown in FIG. 1 showing the dynamic movement of the seat back assembly from one of the adjusted reclined positions;

FIGS. 5A to 5C are respective side views of the seat shown in FIG. 1 separately showing the seat back assembly in various adjusted reclined positions indicated in FIG. 3; and FIGS. 6A to 6C are respective side views of the seat shown in FIG. 1 separately showing the dynamic movement of the seat back assembly indicated in FIG. 4.

DETAILED DESCRIPTION OF THE PREFERRED EMBODIMENT

Figure 1:
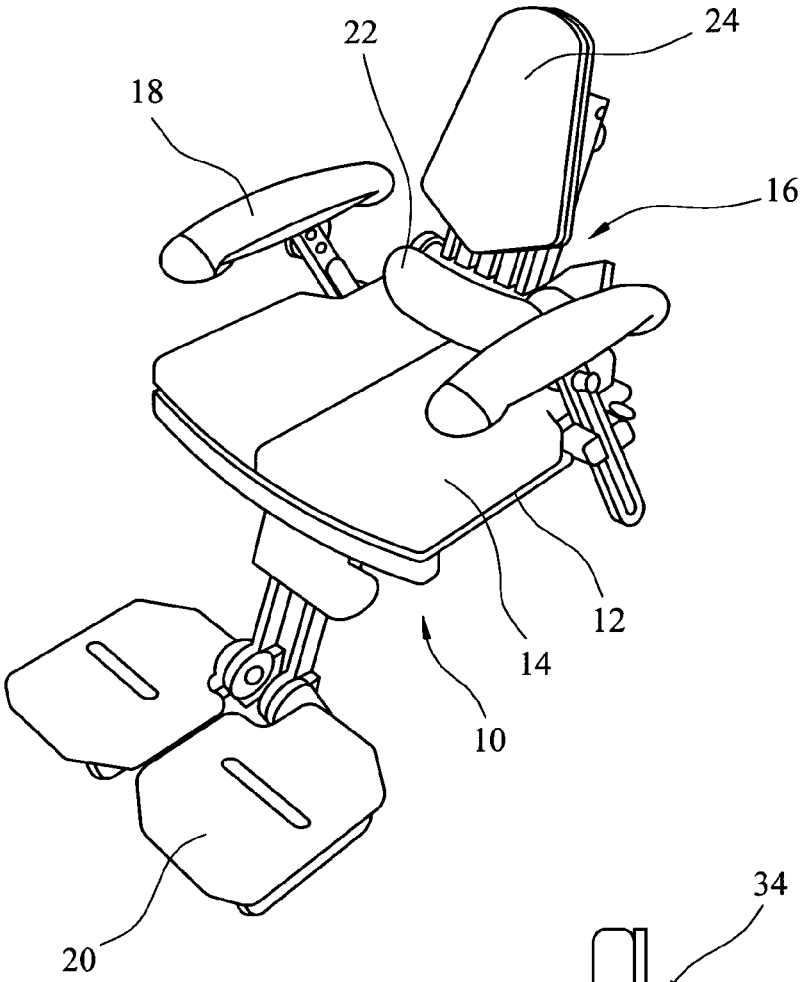
FIG. 1 is a perspective illustration of a seat arrangement in accordance with an embodiment of the invention.

A seating system 10 for a disabled user, an in accordance with an embodiment of the present invention, is shown in FIG. 1. While the invention is particularly directed to a specialist seating systems 10 for a disabled users it may also be more generally applicable.

The seating system 10 may be attached and supported on a suitable base structure (not shown) as is known in the art, for use as a wheelchair, by attachment to a suitable wheeled base, or may be for freestanding use with or without height adjustment, as is known in the art.

Preferably the seating system 10 is a modular seating system for use with various base structures. To this end the seating system 10 includes a mounting spigot 1 to engage a seat base structure. It will however be appreciated that the seating system 10 may incorporate an integral base structure and/or supporting legs.

Figure 2:
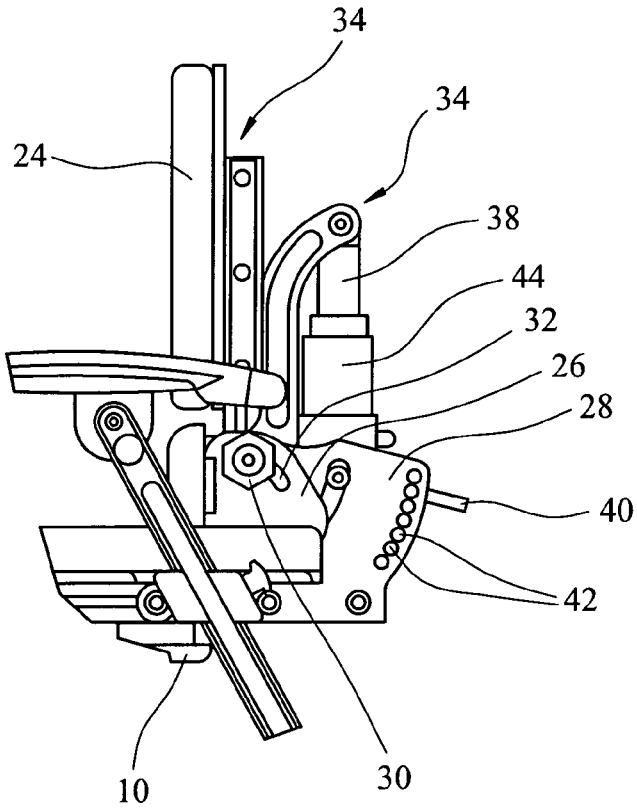
FIG. 2 is a more detailed side view of the seat back assembly mounting of the seat shown in FIG. 1.

The seating system 10 includes a base frame 12 upon which is mounted a seat bottom cushion 14 which defines a generally horizontal seat bottom support surface for supporting a user and upon which a user sits. A seat back assembly, which will be described further below, is also mounted on the seat base frame 12 via a seat back mounting bracket 28 (FIG. 2).

The seat back assembly extends at an angle to the seat bottom cushion, and is generally upright to support the back of a user sitting on the seat. While the seat bottom cushion is generally horizontal and the seat back is generally upright and vertical, it will be recognized that these terms are only relative and indicative of the orientation of the seat bottom cushion and seat back assembly, and that strict compliance is not required. Both the seat bottom cushion and seat back assembly being at an angle to the strict horizontal and vertical planes.

As shown the seating system 10 also includes arm and foot rests 18, 20, the positions and attachments of which are adjustable to suit a user. Such adjustable arm and foot rests 18, 20 are conventional and will not be described further. In addition while such adjustable arm and foot rests 18, 20 are desirable in particular for use in seating systems for disabled users, they may be replaced with different even fixed arrangements, or even omitted in certain other embodiments and in particular in more general seating systems not specifically configured from disabled users.

In more detail, the seat back assembly 16 comprises a lower seat back portion 22 and a separate distinct upper seat back portion 24 disposed adjacent and generally above the lower seat back portion 22. The first lower seat back portion 22 includes a lower support pad defining a first back support surface for supporting a lower portion of a user's back, and in particular a sacral pad for supporting the pelvis and pelvic region of a user seated on the seat.

The second upper seat back portion 24 includes an upper seat pad defining a second upper back support surface for supporting an upper portion of a user's back, and specifically the shoulder region of a users back. The first and second portions 22, 24 while separate and distinct collectively define a support surface for supporting all of a user's back.

Referring additionally to FIG. 2 of the drawings, the lower seat back portion 22 further comprises a lower seat back support bracket 26 attached to the rear of the lower seat back pad. The lower seat back support bracket 26 adjustably attaches the lower seat back portion 22 to a seat back mounting bracket 28 attached to the seat base frame 12 via a mounting bolt (not shown) secured to the seat back mounting bracket 28 with an adjustment knob 30 threaded on a treaded end of the bolt. The bolt is located in an arcuate guide slot 32 in the lower seat back support bracket 26 and the adjustment knob 30 is tightened to clamp the lower seat back support bracket 26 between the adjustment knob 30 and seat back mounting bracket 28 at a position along the arcuate guide slot 32.

In this way the lower seat back portion 22 is adjustably mounted to the seat back mounting bracket 28 and the seat 14, so that it can be independently pivoted and tilted about the mounting bolt, and also forward and backwards and upwards and downwards along the guide slot 32 and relative to the seat back mounting bracket 28 and remainder of the seat, and then clamped in any of the adjusted positions by tightening the adjustment knob 30. In this way, the sacral pad on the lower seat back portion 22 is made adjustable, which allows the dynamic back action to control the angle of the pelvis and accommodate a range of different height users.

The upper seat back portion 24 comprises an upper pad mounted upon an upper seat back support frame 34 which is pivotally attached, via a pivot pin (not shown) at a lower end, to the seat back mounting bracket 28. The support frame 34 also includes a first fixed support arm 36 fixed to the support frame 34. The first arm 36 may, in other embodiments, comprise an integral part of the support frame and the present invention is not intended to be limited in this regard.

A second, movable, support arm 38 is pivotally attached at one end about the same pivot axis and pin as the support frame 34 so as to be pivotable relative to the support frame 34. A distal end of the moveable arm 38 includes a mounting pin 40 which is located in, and moveable along, a guide slot (not shown) in the seat back mounting bracket 28, and is engageable in any one of a number of corresponding reclined position apertures 42 defined in an arc in the seat back mounting bracket 28 to secure the moveable arm 38 in a number of angular positions about its pivotal mounting and the pivotal mounting of the seat back frame 34.

Thus, as shown in FIGS. 3 and 5A-5C, the seat back assembly can be adjusted to, and fixed in, any one of a number of set nominal 'home' reclined positions. A shock absorber 44 is pivotally mounted between a distal end of the fixed arm 36 and the moveable arm 38. The shock absorber fixes the position of the fixed arm 36, and so of the upper seat back 24 relative to the moveable arm 38 by virtue of the length of the shock absorber Referring to FIGS. 3 and 5A-5C, in use, a user sits on the seat bottom cushion 14 with their feet resting on the foot rests 20 and their arms resting on the arm rests 18. The lower portion of the user's back, i.e. the pelvis and pelvic region, is supported by the lower seat back portion 22 and the upper portion of the user's back is supported by the upper seat back portion 24. The lower seat back portion 22 is adjustable relative to the seat back mounting bracket 28 by manually pivoting or tilting it about the mounting bolt and/or forward/backward, upward/downward movement along the guide slot 32 and it can then be clamped in the desired adjusted position relative to the seat back mounting bracket 28 and the seat 14 by tightening the adjustment knob 32.

Adjustment of the upper seat back portion 24 relative to the rest of the seat assembly 10 is effected by applying a load in the direction indicated by arrow A in FIG. 3 to the upper seat back portion 24, when the mounting pin 40 is not engaged with any of the apertures 42. In response to this load, the upper seat back portion 24 pivots about its pivotal mounting and the mounting pin slides along its guide slot until the desired reclined position is reached. The upper seat back portion 24 can be fixed in the desired reclining position by engagement of the mounting pin 40 in one of the apertures 42.

Thus, it will be apparent that, by the above-described mechanism, the upper seat back portion 24 is reclineably adjustable to one of a number of fixed angular positions. In order to return the upper seat back portion 24 to the upright position (or adjust it to another reclining position), the mounting pin 40 can be disengaged from the respective aperture 42 and the upper seat back portion 24 re-adjusted, as described above.

Referring to FIGS. 4 and 6A-6C of the drawings, dynamic movement of the upper seat back portion 24, form the fixed nominal home positions is also possible. This is effected via the shock absorber 44 located between the distal end of the moveable arm 38 and the fixed arm 36. A shock absorber 44 suitable for use in the present invention may comprise a cylindrical housing within which the moveable arm is telescopically mounted for movement. Damping means, in the form of a fluid chamber or biasing spring, is provided within the housing, in communication with the moveable arm 38. As the moveable arm 38 extends into the housing due to movement of the upper back support portion 24 caused by a load applied thereto, the fluid in the chamber or the biasing spring is compressed, thereby applying a tension force against the movement and slowing movement of the upper back support portion 24. Equally, when the load is reduced or removed, a return force is applied to the moveable arm 38 which causes the upper back support portion 24 to return toward the upright forward position.

The tension and/or rebound forces produced by the damping means are preferably adjustable. In the case of a fluid chamber, the size of the fluid chamber may be adjustable for this purpose. In the case of a biasing spring, the preload thereof may be adjustable. Other types of shock absorber in which the tension and rebound are adjustable will be apparent to a person skilled in the art. For example, it is known to provide a shock absorber in a front suspension fork of a mountain bike and such a shock absorber tends to be adjustable for tension and rebound to compensate for, for example, various rider weights, abilities, type of terrain, etc. One example of a particularly suitable adjustable shock absorber which may be used is the BAR Rock Shox produced by SRAM Corporation of Illinois, USA. While this is generally used for mountain bikes it can be advantageously used in this seat application.

Thus, returning to FIGS. 4 and 6A-6C of the drawings, in use, load applied to the upper seat back portion 24 by the user causes the fixed arm 36 to pivot about the pivot axis and the moveable arm 38 extends further into the housing of the shock absorber 44, resisted by the damping force produced by the damping means therein. As the load being applied increases, the upper seat back portion 24 is further reclined until it reaches a maximum reclining position (FIG. 6C). The reclining angle can be reduced simply by reducing the load being applied. When the force is removed, the upper seat back portion 24 is returned to the upright position by the rebound force provided by the shock absorber 44 (see FIG. 4). The shock absorber 44 and damping force provided also resists this return movement slowing the return movement to the set nominal position. This is particularly advantageous for disabled seating and also reduces any impact with a user who may now be sitting more upright. In addition it reduces impact with the remainder of the seat as the seat back portion 24 returns to the nominal set position.

Thus, it will be appreciated that the dynamic action does not affect the back recline mechanism, this can still be set independently. Further benefits include the fact that the back frame and sacral pad work independently which allows the angle of the pelvis to be maintained as the back frame is flexed; the sacral pad is adjustable, which allows the dynamic back action to accommodate a range of different height users; and the shock absorber is adjustable in tension and rebound.

The adjustable shock absorber mechanism 44 has been used in mountain bikes but has never been incorporated into a seating system or wheelchair. It will also be appreciated that a key difference between this adjustable shock absorber mechanism 44 and a traditional gas spring is it is design for cyclic loading. The barrel is larger to assist with heat dispersion and has an air chamber so that the tension can be manually adjusted. Advantages over the conventional gas spring arrangement include less feedback to the user, more comfort, reduced loading and reduction in weight of the seat. In contrast to the above-described embodiment of the invention, conventional dynamic seat back arrangements do not include damping (adjustable or otherwise) for slowing the movement of the seat back (in either direction).

As stated above, the dynamic action (described with reference to FIGS. 4 and 6A-6C) does not affect the back recline mechanism (described with reference to FIGS. 3 and 5A-5C), this can still be set independently.

The overall combination of separate sacral pad and main back rest with relative adjustment and the damping functionality of the shock absorber give overall combined improvement, as well as providing their own respective individual improvements.

More specifically, the adjustable shock absorber could be used as a damper in a seat assembly having a conventional single back rest portion incorporating the upper and lower seat back portions. Equally, the arrangement comprising two separate, independently adjustable, seat back portions could be used with no damping. Furthermore, while shown as separate pads, the upper and lower seat back pads could be integrated into a single back rest with separate moveable frames and/or both portions could be covered by a single cover layer.

The principle and mode of operation of this invention have been explained and illustrated in its preferred embodiment. However, it must be understood that this invention may be practiced otherwise than as specifically explained and illustrated without departing from its spirit or scope.

The invention claimed is:

1. A seat (10) comprising:

a seat bottom (14) defining a generally horizontal support surface for supporting a user's weight, the seat bottom (14) having a rear edge;

a seat back assembly (16) extending generally upwardly from the seat bottom (14) adjacent the rear edge thereof, the seat back portion (16) being moveable in a reclining direction relative to the seat bottom (14) under an applied load over a range of positions;

a shock absorber (44) pivotally mounted between the seat bottom (14) and the seat back assembly (16) for controlling reclining movement of the seat back portion (16) and applying a rebound force in respect of movement of the seat back portion (16) to urge the seat back assembly (16) toward a nominal upright position;

wherein the shock absorber (44) includes an adjustable damper for restraining return motion of the seat back portion (16) when the applied load is reduced;

wherein the shock absorber comprises an arm member (38) having one end attached to the seat back portion (16) and a second end telescopically mounted in a housing containing damping means, wherein, in use, movement of the seat back assembly (16) causes corresponding movement of the second end of said arm member (38) within the housing;

wherein the shock absorber (44) is located behind the seat back assembly (16) and above the seat bottom (14); and wherein the seat back assembly (16) extends generally upright from the seat bottom (14) adjacent the rear edge thereof, the seat back assembly (16) including a lower seat back portion (22) and a separate upper seat back portion (24);

the lower seat back portion (22) defining a lower back support surface for supporting the pelvic region of a user sitting on the seat (10);

the upper seat back portion (24) defining a second back support surface for supporting an upper portion of a user's back, the upper seat back portion (24) being mounted for movement, in use, under a load over a range of angular positions from the nominal upright position while the lower seat back portion (22) remains stationary relative to the seat bottom (14).

2. The seat assembly (10) of claim 1, wherein the lower seat back portion (22) is adjustable between a plurality of fixed positions relative to the seat bottom in at least one of height, angle and longitudinal position relative to the relative to the seat bottom (14).

3. A seat assembly (10) for a disabled user, the seat assembly (10) comprising:

a seat bottom (14) defining a generally horizontal support surface for supporting a user's weight, the seat bottom (14) having a rear edge;

a seat back assembly (16) extending generally upright from the seat bottom (14) adjacent the rear edge thereof, the seat back assembly (16) including a lower seat back portion (22) and a separate upper seat back portion (24);

the lower seat back portion (22) defining a lower back support surface for supporting the pelvic region of a user sitting on the seat (10);

the upper seat back portion (24) defining a second back support surface for supporting an upper portion of a user's back, the upper seat back portion (24) being mounted for movement, in use, under a load over a range of angular positions from a nominal upright position while the lower seat back portion (22) remains stationary relative to the seat bottom (14), with the upper seat back portion (24) biased toward the nominal upright position independently of the lower seat back portion (22) and being moveable relative to the seat bottom (14) independently of the lower seat back portion (22); and an adjustable damper (44) operatively connected between the seat bottom (14) and the upper seat back portion (24), the adjustable damper (44) provided to, in use, resist return movement of the upper seat back portion (24) back toward the nominal upright position.

4. The seat assembly (10) according to claim 3 wherein the adjustable damper (44) includes a shock absorber for applying a damping force in the direction of movement away from the nominal upright position and biasing force in the direction of rebound toward the nominal upright position.

5. The seat assembly (10) of claim 3, wherein the adjustable damper (44) comprises an arm member (38) having one end attached to the upper seat back portion (24) and a second end telescopically mounted in a housing containing damping means, wherein, in use, movement of the upper seat back portion (24) causes corresponding movement of the second end of said arm member (38) within said housing.

6. The seat assembly (10) of claim 3, wherein the adjustable damper (44) is located behind the seat back assembly (16) and above the seat bottom (14).

7. The seat assembly (10) of claim 3, wherein the lower seat back portion (22) is adjustable between a plurality of fixed positions relative to the seat bottom in at least one of height, angle and longitudinal position relative to the relative to the seat bottom (14).

8. The seat assembly (10) of claim 3, wherein the upper seat back portion (24) is moveable in a reclining direction to a selected one of a number of fixed nominal angular positions.

9. The seat assembly (10) of claim 8, wherein the upper seat back portion (24) is fixed in its selected nominal angular position by a mounting pin (40).

10. A seat assembly (10) for a disabled user, the seat assembly (10) comprising:

a seat bottom (14) defining a generally horizontal support surface for supporting a user's weight, the seat bottom (14) having a rear edge;

a seat back assembly (16) extending generally upright from the seat bottom (14) adjacent the rear edge thereof, the seat back assembly (16) including a lower seat back portion (22) and a separate upper seat back portion (24);

the lower seat back portion (22) configured to support a user's pelvis, the lower seat back portion being, in use, fixed in position relative to the seat bottom (14);

an upper seat back portion (24) for supporting an upper portion of a user's back, the lower seat back portion (22) and upper seat back portion (24) being independently moveable relative to one another the upper seat back portion (24) being reclineable to one of a number of fixed nominal angular positions and configured for dynamic angular movement under a load over a range of positions from said fixed nominal angular positions; and a shock absorber (44) having adjustable damping means for providing, in use, a required level of tension and rebound in relation to the dynamic angular movement of the upper seat back portion (24) and for restraining motion of said upper seat back portion (24) and at least restraining return motion of said upper seat back portion (24) toward a nominal upright position when the applied load is removed or reduced to thereby control dynamic movement of the upper seat back portion (24).

11. The seat assembly (10) of claim 10, wherein the adjustable damper (44) is located behind the seat back assembly (16) and above the seat bottom (14).

12. A seat (10) comprising:

a seat bottom (14) defining a generally horizontal support surface for supporting a user's weight, the seat bottom (14) having a rear edge;

a seat back assembly (16) extending generally upwardly from the seat bottom (14) adjacent the rear edge thereof, the seat back portion (16) being moveable in a reclining direction relative to the seat bottom (16) under an applied load over a range of positions;

a shock absorber (44) pivotally mounted between the seat bottom (14) and the seat back assembly (16), the shock absorber being adjustable to control reclining movement of the seat back portion (16) and to apply a rebound force in respect of movement of said seat back portion (16) to urge the seat back assembly (16) toward a nominal upright position; and a mounting bracket (28) interconnecting the shock absorber (44) and the seat bottom (14), the mounting bracket (28) configured to retain the seat back assembly (16) in a selected one of a number of fixed nominal angular reclining positions without engaging the shock absorber (44).

13. The seat assembly (10) of claim 12, wherein the mounting bracket (28) includes a mounting plate having a plurality of reclined position apertures (42) defined in an arc.

14. The seat assembly (10) of claim 13, wherein the mounting bracket (28) includes a mounting pin (40) selectively engageable in the reclined position apertures (42) for fixing the seat back assembly (16) in the selected nominal angular positions.

15. The seat assembly (10) of claim 12, wherein the shock absorber (44) comprises an arm member (38) having one end attached to the upper seat back portion (24) and a second end telescopically mounted in a housing containing damping means, wherein, in use, movement of the upper seat back portion (24) causes corresponding movement of the second end of said arm member (38) within said housing.

* * * * *